US007311081B2

(12) United States Patent
Williams et al.

(10) Patent No.: US 7,311,081 B2
(45) Date of Patent: Dec. 25, 2007

(54) ELECTRONIC THROTTLE CONTROL SYSTEM WITH INTEGRATED CONTROLLER AND POWER STAGE

(75) Inventors: Kyle Shawn Williams, Howell, MI (US); Joseph Funyak, Rochester Hills, MI (US)

(73) Assignee: Infineon Technologies AG, Munich (DE)

( * ) Notice: Subject to any disclaimer, the term of this patent is extended or adjusted under 35 U.S.C. 154(b) by 34 days.

(21) Appl. No.: 11/178,095

(22) Filed: Jul. 8, 2005

(65) Prior Publication Data

US 2007/0006845 A1 Jan. 11, 2007

(51) Int. Cl.
*F02D 11/10* (2006.01)

(52) U.S. Cl. ..... 123/399; 318/678; 318/681; 327/363

(58) Field of Classification Search ..... 123/361, 123/399; 327/363; 318/678, 681; 701/103, 701/115

See application file for complete search history.

(56) References Cited

U.S. PATENT DOCUMENTS

| | | | | |
|---|---|---|---|---|
| 5,835,878 | A * | 11/1998 | Saito et al. | 701/94 |
| 6,333,617 | B1 | 12/2001 | Itabashi et al. | |
| 6,816,772 | B2 | 11/2004 | Kondo | |
| 6,976,470 | B2 * | 12/2005 | Hoshino et al. | 123/399 |
| 2003/0024506 | A1 * | 2/2003 | Oda et al. | 123/399 |
| 2003/0163241 | A1 * | 8/2003 | Kondo | 123/399 |

* cited by examiner

*Primary Examiner*—Stephen K. Cronin
*Assistant Examiner*—Arnold Castro
(74) *Attorney, Agent, or Firm*—Kacvinsky LLC

(57) ABSTRACT

One embodiment includes an apparatus comprising a closed loop feedback controller and a power output stage to couple to the closed loop feedback controller. The closed loop feedback controller and the power output stage are combined to form a single element.

30 Claims, 3 Drawing Sheets

ELECTRONIC THROTTLE CONTROL SYSTEM WITH INTEGRATED CONTROLLER AND POWER STAGE

BACKGROUND

An internal combustion engine may use an electronic throttle control system to perform throttle control operations. For example, the electronic throttle control system may control the angular position of a throttle valve in a throttle valve assembly. Implementations of electronic throttle control systems, however, may use a relatively large number of separate components, thereby potentially increasing the complexity and cost of the system. Consequently, there may be a need for an improved electronic throttle control system to solve these and other problems.

SUMMARY

One embodiment includes an apparatus comprising a closed loop feedback controller and a power output stage to couple to the closed loop feedback controller. The closed loop feedback controller and the power output stage are combined to form a single element.

DETAILED DESCRIPTION

Figure 1:
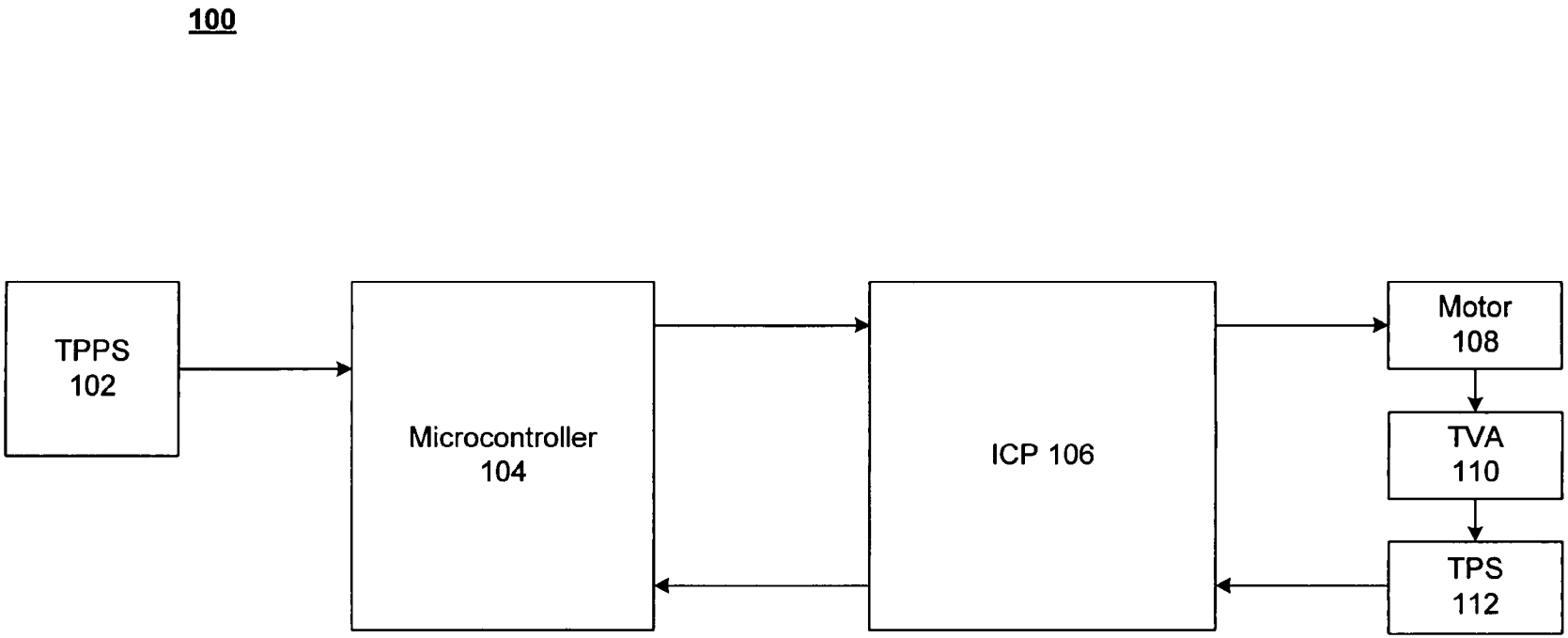
FIG. 1 illustrates one embodiment of a system.

FIG. 1 illustrates one embodiment of a system. FIG. 1 illustrates a block diagram of a system 100. System 100 includes multiple elements. The elements may be implemented as one or more circuits, components, registers, processors, software subroutines, modules, or any combination thereof, as desired for a given set of design or performance constraints. Although FIG. 1 shows a limited number of elements in a certain topology by way of example, it may be appreciated that system 100 may include more or less elements in any type of topology as desired for a given implementation.

In various embodiments, system 100 comprises an electronic throttle control system for an internal combustion engine used in a vehicle. The vehicle may be any vehicle arranged to use an internal combustion engine, where the engine uses a throttle valve to control air intake to the engine. Examples of suitable vehicles include an automobile, truck, motorcycle, snowmobile, recreational vehicle, among various other motorized vehicles.

In various embodiments, system 100 includes a throttle pedal position sensor (TPPS) 102. TPPS 102 may be one of many sensors used to detect physical attributes or characteristics of system 100. For example, in a mechanical system, sensors are used to detect component displacement, rotation, speed, and position relative to other components. In automotive applications, for example, sensors often are employed to detect crank shaft rotation and position, engine speed and position, gear speed, automotive ignition system functions, the speed of electronically controlled transmissions, and wheels for anti-lock braking systems (ABS) and traction control systems. In one embodiment, TPPS 102 may be used to detect the position of a throttle pedal for a throttle pedal assembly. For example, TPPS 102 is implemented using one or more potentiometers designed to track the movement of the throttle pedal for a range of positions between an idle position and a wide open throttle (WOT) position. TPPS 102 may be attached to one or more sides of the throttle pedal assembly. TPPS 102 may output digital or analog signals to system microcontroller 102. TPPS 102 may be connected to microcontroller 104 with an appropriate interface and conditioning circuits to couple the analog or digital output signals of TPPS 102 with microcontroller 104.

In various embodiments, system 100 includes a microcontroller 104 to connect to TPPS 102. In one embodiment, microcontroller 104 comprises a main system controller for the internal combustion engine. Microcontroller 104 may be implemented using any type of processing system having a processor and memory. Examples of a processor include a complex instruction set computer (CISC) microprocessor, a reduced instruction set computing (RISC) microprocessor, a very long instruction word (VLIW) microprocessor, a processor implementing a combination of instruction sets, or other processor device. In one embodiment, for example, microcontroller 104 may be implemented as a dedicated processor, such as a controller, microcontroller, embedded processor, a digital signal processor (DSP), a field programmable gate array (FPGA), a programmable logic device (PLD), and so forth. Examples of memory include any machine-readable or computer-readable media capable of storing data, including both volatile and non-volatile memory. For example, the memory may be implemented as read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. It is worthy to note that some portion or all of the memory may be included on the same integrated circuit as the processor or controller. Alternatively, some portion or all of the memory may be disposed on an integrated circuit or other medium external to the integrated circuit of the processor or controller.

In various embodiments, microcontroller 104 is programmed to receive and interpret the output of TPPS 102. In one embodiment, microcontroller 104 uses the output to calculate a target throttle position of a throttle valve in a throttle valve assembly (TVA) 112, as described in more detail below.

In various embodiments, system 100 includes an integrated closed loop feedback controller and a power output stage (ICP) 106 to connect with microcontroller 104. A closed loop feedback controller and a power output stage are typically implemented as separate elements. ICP 106 combines the structure and operations of a closed loop feedback controller and a power output stage into a single element, component or device. Combining the structure and operations of a closed loop feedback controller and a power output stage into a single element, component or device may reduce the number of elements in system 100 as compared to conventional systems, thereby reducing associated cost and complexity. Examples of a single element, component or device may include a circuit, an integrated circuit (IC), a single die, a single microchip, a semiconductor device, a single package, and so forth. The embodiments, however, are not limited in this context.

In various embodiments, ICP 106 comprises a closed loop feedback controller. An example of a closed loop feedback controller includes an electronic throttle control (ETC) microcontroller arranged to control operations of an electronic throttle control system. In one embodiment, for example, ICP 106 receives the target throttle position from microcontroller 104. The ETC microcontroller of ICP 106 generates one or more throttle angle commands for a throttle valve. The throttle angle commands are used to control an angular position of the throttle valve to correspond to a throttle pedal position as measured by TPPS 102. In one embodiment, the ETC microcontroller includes a feedback control system to monitor and adjust the throttle valve to ensure the throttle valve is at the proper angle. The ETC microcontroller may be implemented using any of the examples given with respect to microcontroller 104.

In various embodiments, ICP 106 comprises a power output stage. The power output stage drives a motor in response to the throttle angle commands received from the ETC microcontroller. In one embodiment, for example, the power output stage may be implemented as an H-Bridge circuit. An H-Bridge circuit comprises a motor drive circuit arranged to drive the rotation of an electronic actuator motor in at least two directions. In one embodiment, for example, the H-Bridge circuit includes four power switches and a power driver stage. The H-Bridge circuit drives the rotation of an electronic actuator motor, such as motor 108, based upon the state of the four power switches. More particularly, the H-Bridge circuit varies the state of the four power switches in response to the throttle angle commands received from microcontroller 104. The H-Bridge circuit outputs power in the form of motor drive signals. The motor drive signals drives a motor to actuate or move a throttle valve to the target throttle angle as determined by microcontroller 104 and/or the ETC microcontroller of ICP 106.

In various embodiments, system 100 includes a motor 108 to connect to ICP 106. The absence of any mechanical connections between the throttle pedal assembly and the throttle valve may necessitate use of an electric actuator motor. Motor 108 may comprise any suitable electric actuator motor for controlling the angular position of the throttle valve. In one embodiment, for example, motor 108 comprises a direct current (DC) servomotor and associated gearing arranged to connect to the throttle valve or throttle valve assembly. Motor 108 should also be capable of rotating in a forward direction and a reverse direction under the control of the motor drive signal output from ICP 106.

In various embodiments, system 100 includes a throttle valve assembly (TVA) 110. In one embodiment, TVA 110 comprises a throttle body having a throttle valve disposed within the throttle body. An example of a throttle valve includes a butterfly valve. The throttle valve may be spring-loaded to maintain a constant position in the absence of additional force from a throttle blade actuator, such as motor 108. The angle of the throttle valve relative to the throttle body controls the amount of air flow into the internal combustion engine. Motor 108 controls the angle of the throttle valve in response to the motor drive signals received from ICP 106. In one embodiment, for example, ICP 106 outputs a first motor drive signal to motor 108 to cause motor 108 to rotate in a first direction to increase the angle of the throttle valve. ICP 106 outputs a second motor drive signal to motor 108 to cause motor 108 to rotate in a second direction to decrease the angle of the throttle valve. In this manner, ICP 106 and motor 108 causes the throttle valve to move to the proper angular position corresponding to the throttle pedal position as indicated by TPPS 102 and microcontroller 104.

In various embodiments, system 100 includes a throttle position sensor (TPS) 112. TPS 112 is positioned in proximity to motor 108, TVA 110 or a throttle valve within TVA 110, in a manner that allows TPS 112 to detect the actual angular position of a throttle valve for TVA 110 at any given moment in time. In one embodiment, for example, TPS 112 is located adjacent to, or adjoining with, motor 108. In one embodiment, for example, TPS 112 is located adjacent to, or adjoining with, TVA 110 or the throttle valve of TVA 110. TPS 112 is connected to ICP 106 with an appropriate interface and conditioning circuits to couple the analog or digital output signals of TPS 112 with ICP 106. ICP 106 is programmed to receive and interpret the output of TPS 112, and use the output as feedback to adjust or maintain the angular position of the throttle valve via motor 108.

In general operation, system microcontroller 104 controls various operations of an internal combustion engine, such as fuel control operations, ignition control operations, and so forth. In addition, microcontroller 104 also controls throttle control operations for an electronic throttle control system. In one embodiment, for example, microcontroller 104 calculates a target throttle angle based on the signals received from TPPS 102. Microcontroller 104 transmits the calculated target throttle angle in the form of a throttle position command (TP_CMD or SETPOINT) to ICP 106. Microcontroller 104 may also monitor operations of ICP 106 via one or more diagnostic signals, as well as potentially disable operations of ICP 106 if needed for maintenance or faults.

In general operation, ICP 106 controls throttle drive operations for system 100. ICP 106 receives the target throttle angle from microcontroller 104, and outputs a motor drive signal to motor 108. In addition, ICP 106 may also monitor operations of system microcontroller 104 via one or more diagnostic signals. Furthermore, ICP 106 may operate as a closed loop feedback controller to receive output signals from TPC 112 to adjust the current angular position of the throttle valve of TVA 110 to match the target throttle angle calculated by microcontroller 104.

In various embodiments, ICP 106 combines a closed loop feedback controller and a power output stage into a single integrated element, component or device. The single integrated element, component or device may be implemented as, for example, a circuit, an IC, a single die, a single package, a semiconductor device, a chip, a microchip, and so forth. In one embodiment, for example, ICP 106 comprises an ETC microcontroller implemented as a state machine on the same die as the power output stage (monolithic). In one embodiment, for example, ICP 106 comprises an ETC microcontroller implemented in the same package as the power output stage, using a chip-by-chip technique, chip-on-chip technique, system-on-chip technique, and so forth. Combining the closed feedback loop controller and power output stage into a single integrated element, component or device provides several advantages, such as improved cost and reliability due to the reduced number of components. Furthermore, such a combination allows tighter tolerances and better system integration of the various elements. Examples for ICP 106 are described in more detail with reference to FIG. 2.

Figure 2:
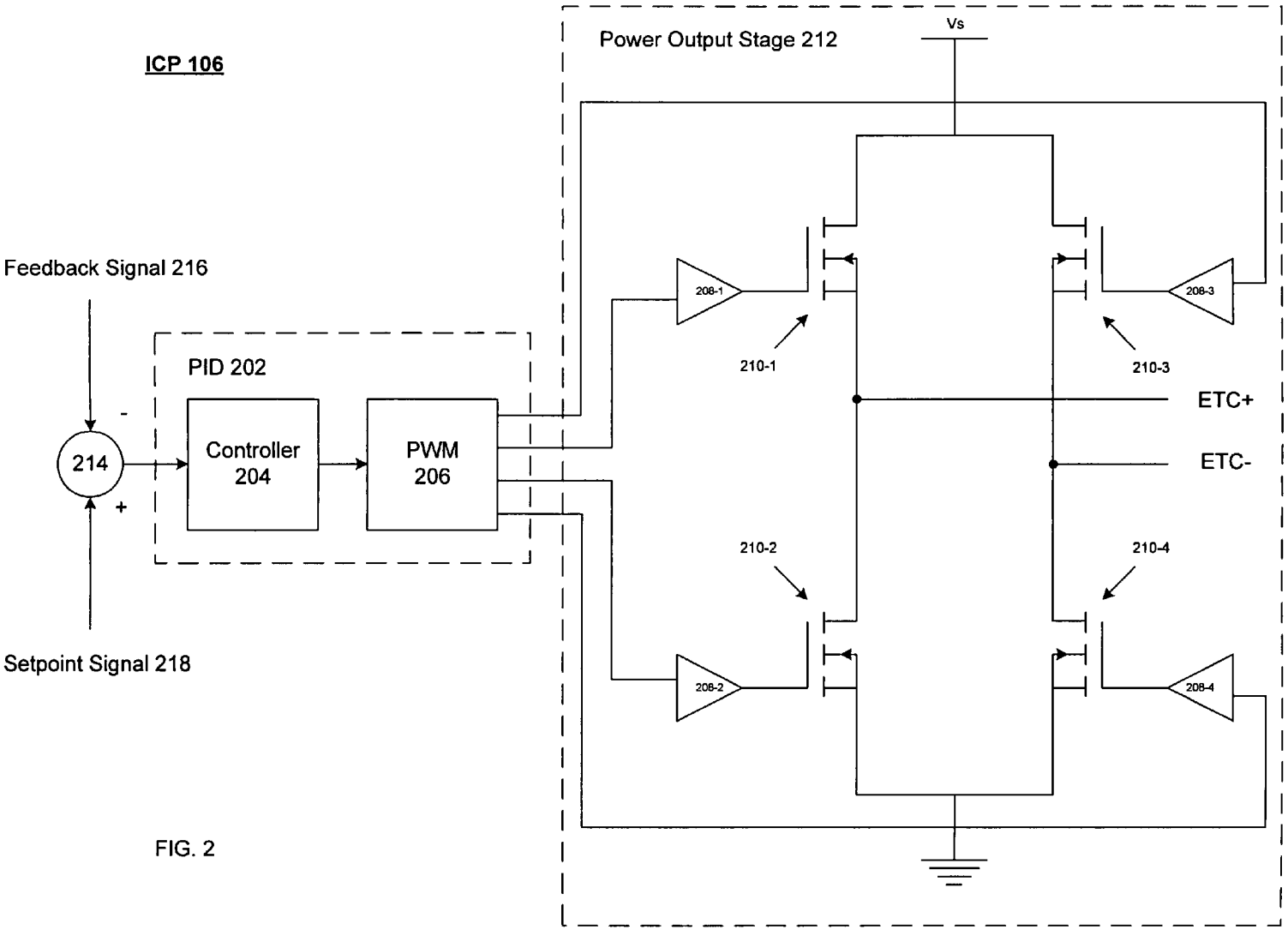
FIG. 2 illustrates one embodiment of an integrated controller for the system.

FIG. 2 illustrates one embodiment of an integrated controller. FIG. 2 illustrates an integrated controller that may be representative of, for example, ICP 106 as described with reference to FIG. 1. ICP 106 as described with reference with FIG. 2 may include multiple elements. The elements may comprise, or be implemented as, one or more circuits, components, registers, processors, software subroutines, modules, or any combination thereof, as desired for a given set of design or performance constraints. Although FIG. 2 shows a limited number of elements in a certain topology by way of example, it may be appreciated that ICP 106 may include more or less elements in any type of topology as desired for a given implementation. Furthermore, the embodiments are not limited to the example given in FIG. 2.

In various embodiments, ICP 106 comprises a proportional, integral, and derivative (PID) control element 202. PID control element 202 performs feedback control of motor 108 to reduce errors between a signal from TPS 112 which detects an actual throttle opening of the throttle valve, and a signal from microcontroller 104 that indicates a target throttle angle. In one embodiment, for example, PID control element 202 is responsive to an error signal generator 214. In one embodiment, for example, error signal generator 214 may comprise an adder that subtracts an actual throttle angle via feedback signal 216 sensed from TVA 110 by TPS 112, and the target throttle angle signal via setpoint signal 218 from microcontroller 104 as sensed from TPPS 102, to form an error signal for output to PID 202.

In various embodiments, PID element 202 includes a controller 204. Controller 204 may be representative of a closed loop feedback controller such as an ETC microcontroller as described with reference to FIG. 1. In one embodiment, controller 204 receives the error signal from error signal generator 214, and outputs angle commands represented by an angle position signal. The angle commands control the angular position of the throttle valve of TVA 110 via motor 108.

In various embodiment, PID element 202 includes a pulse width modulation (PWM) element 206 connected to controller 204. PWM element 206 may be used in combination with power output stage 212 to control the speed and/or rotation of motor 108. In one embodiment, for example, PWM element 206 receives the angle position signal from controller 204. PWM element 206 is arranged to output pulse width modulated signals to a power output stage 112. In one embodiment, for example, motor 108 comprises a bi-directional DC servomotor. PWM element 206 may control the speed and rotation of motor 108 using a particular duty cycle. A duty cycle comprises a percentage reading or ratio between ON and OFF states, or stated another way, the amount of time a signal is high compared to the amount of time the signal is low. Varying the duty cycle may vary the average current that flows through a load (e.g., motor 108) and the average direction it flows. Therefore, changing the ratio of the ON time to the OFF time may be used to vary the speed of the motor. For example, a duty cycle arranged with a current pulse that is ON 80% of the time and OFF 20% of the time may cause motor 108 to operate at approximately 80% speed. Furthermore, a duty cycle ratio may be used to determine a rotational direction for bi-directional DC servomotor 108. For example, a duty cycle ratio of less than 50% may cause motor 108 to rotate in one direction (e.g., close a throttle valve), while a duty cycle ratio of more than 50% may cause motor 108 to rotate in another direction (e.g., open a throttle valve), or vice-versa. A straight 50% duty cycle ratio may cause an OFF state with the average current through motor 108 being zero (0). It may be appreciated that the particular pulse widths and duty cycle ratio values may vary according to any number of design and performance constraints desired for a given implementation. The embodiments are not limited in this context.

In various embodiments, PWM element 206 generates a pulse width modulated duty cycle ratio in accordance with the angle position signal from controller 204. PWM element 206 generates PWM output signals with the appropriately calculated duty cycle ratios to power output stage 212. Power output stage 212 drives DC motor 108 through the associated gear train to open or close the throttle valve at a desired speed and direction to attain the exact desired position to control an amount of air intake to the engine.

In various embodiments, ICP 106 comprises a power output stage 212 to connect to PID element 202. In one embodiment, for example, power output stage 212 is implemented as an H-Bridge circuit. H-Bridge circuit 212 comprises four voltage translators 208-1-4 connected to four power switches 210-1-4, respectively. Voltage translators 208-1-4 may comprise, for example, one or more buffers and/or level shifters. In one embodiment, for example, PWM element 206 comprises four output lines, with each output line operating as input to one of corresponding translators 208-1-4 of H-Bridge circuit 212. Power switches 210-1-4 may be implemented using any appropriately arranged transistors. In one embodiment, for example, power switches 210-1-4 are implemented using four N-channel metal-oxide-semiconductor field-effect transistor (MOSFET) elements suitable for driving high current motors, such as motor 108. As shown in FIG. 2, the outputs of translators 210-1-4 are each connected to a corresponding gate of N-MOSFET 210-1-4, respectively. The source of N-MOSFET 210-1 is connected to the drain of N-MOSFET 210-2. Similarly, the source of N-MOSFET 210-3 is connected to the drain of N-MOSFET 210-4. The drains of N-MOSFET 210-1, 210-3 are connected, while the sources of N-MOSFET 210-2, 210-4 are connected. A first output ETC+ is connected to the source-drain connection between N-MOSFET 210-1, 210-2. A second output ETC− is connected to the source-drain connection between N-MOSFET 210-3, 210-4.

In general operation, PWM element 206 controls the ETC+, ETC− outputs of H-Bridge 212 via its four output signals connected to translators 208-1-4. PWM element 206 asserts (logic 1) the output lines connected to 208-1, 208-4 to turn power switches 210-1, 210-4 to an ON state thereby allowing current to flow between the drain and source of each switch, and de-assert (logic 0) the output lines connected to 208-2, 208-3 to turn power switches 210-2, 210-3 to an OFF state thereby preventing conduction between the drain and source of each switch. This causes the outputs ETC+, ETC− to have a first polarity to cause motor 108 to rotate in a first direction (e.g., a forward direction). PWM element 206 de-asserts (logic 0) the output lines connected to 208-1, 208-4 to turn power switches 210-1, 210-4 to an OFF state, and asserts (logic 1) the output lines connected to 208-2, 208-3 to turn power switches 210-2, 210-3 to an ON state. This causes the outputs ETC+, ETC− to have a second polarity to cause motor 108 to rotate in a second direction (e.g., a reverse direction). Furthermore, PWM element 206 may control the speed of motor 108 by causing the outputs ETC+, ETC− to have a current flow causing motor 108 to increase or decrease the speed of motor 108. In this manner, PWM element 206 may control the speed and rotation of motor 108 via its PWM outputs to actuate movement of the throttle valve of TVA 110.

Operations for the above embodiments may be further described with reference to the following figures and accompanying examples. Some of the figures may include a logic flow. Although such figures presented herein may include a particular logic flow, it can be appreciated that the logic flow merely provides an example of how the general functionality as described herein can be implemented. Further, the given logic flow does not necessarily have to be executed in the order presented unless otherwise indicated. In addition, the given logic flow may be implemented by a hardware element, a software element executed by a processor, or any combination thereof. The embodiments are not limited in this context.

Figure 3:
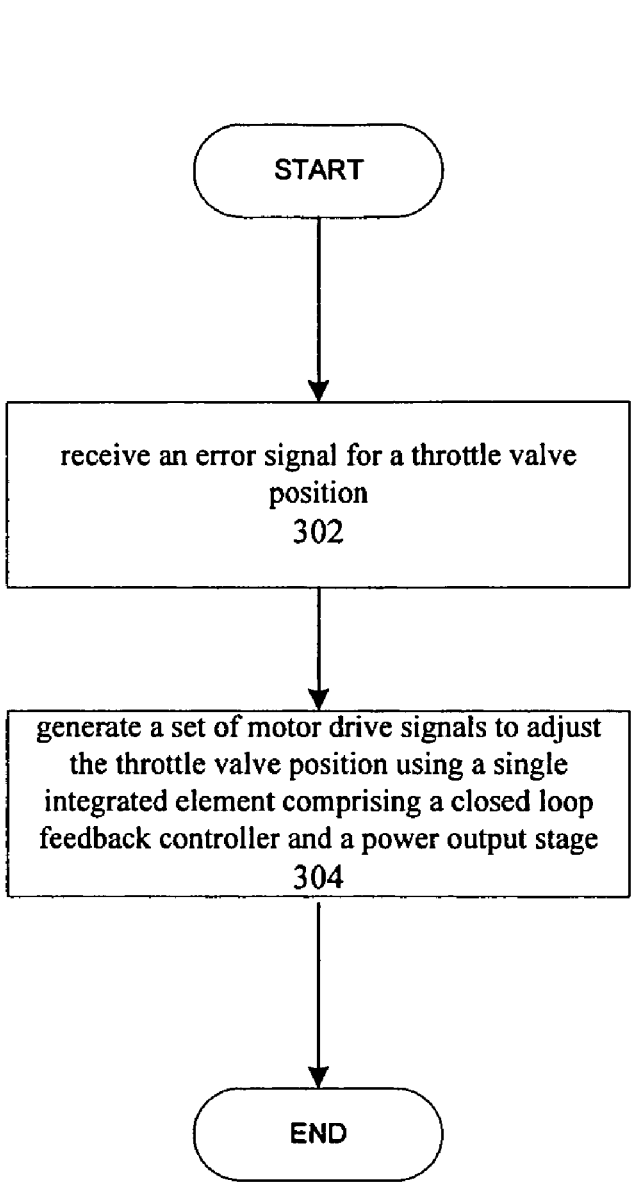
FIG. 3 illustrates one embodiment of a logic diagram.

FIG. 3 illustrates one embodiment of a logic flow. FIG. 3 illustrates a block flow diagram of a logic flow 300. Logic flow 300 may be representative of the operations executed by one or more embodiments described herein, such as system 100, integrated controller 106, and so forth. As shown in logic flow 300, an error signal for a throttle valve position is received at block 302. A set of motor drive signals are generated to adjust the throttle valve position using a single integrated element comprising a closed loop feedback controller and a power output stage at block 304. The embodiments are not limited in this context.

In one embodiment, an angle position signal using the error signal is generated. A pulse width modulation signal is generated using the angle position signal. The motor drive signals are generated using the pulse width modulation signal. The embodiments are not limited in this context.

In one embodiment, a target throttle angle to form a setpoint signal is determined. An actual throttle angle is measured to form a feedback signal. The error control signal is generated using the setpoint signal and the feedback signal. The embodiments are not limited in this context.

In various embodiments, ICP 106 comprises an integrated closed loop feedback controller and a power output stage. In one embodiment, for example, these elements may be integrated or fabricated into a single element, component or device. In one embodiment, for example, ICP 106 is integrated or fabricated by combining controller 204 implemented as a state machine on the same die as H-Bridge circuit 212 (monolithic). In one embodiment, for example, ICP 106 is integrated or fabricated by implementing controller 204 in the same package as H-Bridge circuit 212, using chip-by-chip, chip-on-chip, system-on-chip, and other fabrication, manufacturing, and/or semiconductor process techniques. The embodiments are not limited in this context.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an integrated circuit, an application specific integrated circuit (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

In the description and claims, the terms coupled and connected, along with their derivatives, may be used. In particular embodiments, connected may be used to indicate that two or more elements are in direct physical or electrical contact with each other. Coupled may also mean that two or more elements are in direct physical or electrical contact. Coupled may also mean, however, that two or more elements may not be in direct contact with each other, but yet may still cooperate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

an error signal generator to connect to a microcontroller and to form an error signal in response to a feedback signal and a setpoint signal:

a closed loop feedback controller; coupled to said error signal generator and responsive to said error signal; and;

a power output stage coupled to said closed loop feedback controller, said error signal generator, said closed loop feedback controller and said power output stage combined to form a single element separate from said microcontroller.

2. The apparatus of claim 1, wherein said single element comprises at least one of a circuit, an integrated circuit, a single die, a single microchip, a semiconductor device, and a single package.

3. The apparatus of claim 1, wherein said closed loop feedback controller comprises an electronic throttle control microcontroller.

4. The apparatus of claim 1, wherein said power output stage comprises an H-Bridge circuit.

5. An apparatus, comprising:

an error signal generator to connect to a microcontroller and to form an error signal in response to a feedback signal and a setpoint signal:

a proportional, integral and derivative control element coupled to said error signal generator and responsive to said error signal;

said proportional, integral and derivative control element comprising a closed loop feedback controller and a pulse width modulation element; and a power output stage coupled to said and wherein said proportional, integral and derivative control element;

wherein said error signal generator, said proportional, integral and derivative control element and said power output stage are formed as single component separate from said microcontroller.

6. The apparatus of claim 5, wherein said single component comprises at least one of a circuit, an integrated circuit, a single die, a single microchip, a semiconductor device, and a single package.

7. The apparatus of claim 5, comprising a motor to couple said proportional, integral, and derivative control element, said motor to rotate in at least two directions in response to motor drive signals.

8. The apparatus of claim 5, comprising a throttle valve assembly coupled to a motor, said throttle valve assembly to include a throttle valve, said motor to move said throttle valve as said motor rotates.

9. The apparatus of claim 5, wherein said power output stage comprises an H-Bridge circuit.

10. An apparatus, comprising:

an error signal generator to connect to a microcontroller and to generate an error signal in response to a feedback signal and a setpoint signal;

a proportional, integral and derivative control element coupled to said error signal generator, and responsive to said error signal, said proportional, integral and derivative control element comprising:

a controller receiving said error signal and outputting an angle position signal; and a pulse width modulation element coupled to said controller, said pulse width modulation element receiving said angle position signal and outputting a pulse width modulation signal; and a power output stage coupled to said proportional, integral and derivative control element, said power output stage receiving said pulse width modulation signal and outputting motor drive signals;

wherein said error signal generator, said proportional, integral and derivative control element and said power output stage are integrated as a single device separate from said microcontroller.

11. The apparatus of claim 10, wherein said single device comprises at least one of a circuit, and integrated circuit, a single die, a single microchip, a semiconductor device, and a single package.

12. The apparatus of claim 10, wherein said microcontroller comprises system controller coupled to said error signal generator, said system controller outputting said setpoint signal representing a target throttle angle; and further comprising a throttle position sensor coupled to said error signal generator, said throttle position sensor outputting said feedback representing an actual throttle angle.

13. The apparatus of claim 12, further comprising a throttle pedal position sensor coupled to said system controller, said throttle pedal position sensor sensing a position of a throttle pedal.

14. The apparatus of claim 10, comprising:

a motor coupled to said power output stage; and a throttle valve assembly coupled to said motor, said throttle valve assembly including a throttle valve, said motor moving said throttle valve in response to said motor drive signals.

15. The apparatus of claim 10, wherein said power output stage comprises an H-Bridge circuit.

16. An apparatus, comprising:

system control means for receiving a throttle pedal position sensor signal;

error signal generating means for generating an error signal; in response to a feedback signal and a setpoint signal; and closed loop feedback control and power output means for receiving said error signal and outputting motor drive signals, wherein said error signal generating means and closed loop feedback control and power output means comprise a single component separate from said system control means for receiving said throttle pedal position sensor signal.

17. The apparatus of claim 16, wherein said single component comprises at least one of a circuit, an integrated circuit, a single die, a single microchip, a semiconductor device, and a single package.

18. The apparatus of claim 16, said closed loop feedback control and power output means comprising:

means for receiving said error signal and outputting an angle position signal;

means for receiving said angle position signal and outputting a pulse width modulation signal; and means for receiving said pulse width modulation signal and outputting said motor drive signals.

19. The apparatus of claim 16, comprising:

means for outputting a setpoint signal representing a target throttle angle; and means for outputting a feedback signal representing an actual throttle angle.

20. A system, comprising:

an internal combustion engine having a throttle valve assembly with a throttle valve; and an electronic throttle control system coupled with said internal combustion engine, said electronic throttle control system controlling a position for said throttle valve, said electronic throttle control system comprising:

an error signal generator to connect to a microcontroller and to form an error signal in response to a feedback signal and a setpoint signal;

a closed loop feedback controller coupled to said error signal generator and responsive to said error signal;

a pulse width modulation element coupled to said closed loop feedback controller; and power output stage coupled to said pulse width modulation element;

wherein said signal generator, said closed loop controller, said pulse width modulation element said power output stage are combined into a single element seperate from said microcontroller.

21. The system of claim 20, wherein said single element comprises at least one of a circuit, an integrated circuit, a single die, a single microchip, a semiconductor device, and a single package.

22. The system of claim 20, wherein said microcontroller comprises a system controller outputting said setpoint signal representing a target throttle angle;

further comprising a throttle position sensor outputting said feedback signal representing an actual throttle angle; and said error signal generator coupled to said system controller and said throttle position sensor, said error signal generator receiving said setpoint signal and said feedback signal, and outputting said error signal to adjust said position for said throttle valve.

23. The system of claim 20, comprising:

a motor coupled to said power output stage, said motor rotating in a forward direction and a reverse direction; and a throttle valve assembly coupled to said motor, said throttle valve assembly including said throttle valve, said motor moving said throttle valve as said motor rotates in said forward direction and said reverse direction.

24. The system of claim 20, wherein said power output stage comprises an H-Bridge circuit.

25. A method, comprising:

receiving a throttle pedal position sensor signal at a microcontroller;

an error signal generator to connect to a microcontroller and to generate an error signal in response to a feedback signal and a setpoint signal;

receiving an error signal for a throttle valve position; at a cloased loop feedback controller; and generating a set of motor drive signals to adjust said throttle valve position in response to said error signal using a single integrated element comprising said error signal generator, said closed loop feedback controller and a power output stage, said single integrated element being separate from said microcontroller.

26. The method of claim 25, comprising:

generating an angle position signal using said error signal;

generating a pulse width modulation signal using said angle position signal; and generating said motor drive signals using said pulse width modulation signal.

27. The method of claim 25, comprising:

determining a target throttle angle to form said setpoint signal;

measuring an actual throttle angle to form said feedback signal; and generating said error control signal using said setpoint signal and said feedback signal.

28. A method, comprising:

receiving a throttle pedal position sensor signal at a microcontroller;

generating an error control signal for a throttle valve position using a setpoint signal and a feedback signal; and adjusting said throttle valve position in response to said error control signal using a single integrated element comprising said error signal generator, a closed loop feedback controller coupled to said error signal generator and responsive to said error control signal, and a power output stage, said single integrated element being separate from said microcontroller.

29. The method of claim 28, comprising:

generating an angle position signal using said error control signal;

generating a pulse width modulation signal using said angle position signal; and generating said motor drive signals using said pulse width modulation signal.

30. The method of claim 28, comprising generating a set of motor drive signals to adjust said throttle valve position in response to said error control signal.

* * * * *

UNITED STATES PATENT AND TRADEMARK OFFICE

CERTIFICATE OF CORRECTION

PATENT NO. : 7,311,081 B2
APPLICATION NO. : 11/178095
DATED : December 25, 2007
INVENTOR(S) : Williams et al.

It is certified that error appears in the above-identified patent and that said Letters Patent is hereby corrected as shown below:

In claim 1, at column 8, line 31 delete “;”.
In claim 1, at column 8, line 33 delete “;”.

In claim 5, at column 8, line 58 delete “and wherein said”.

In claim 7, at column 9, line 2 insert --to-- before “said”.
In claim 10, at column 9, line 16 delete “,”.

In claim 12, at column 9, line 38 insert --a-- before “system”.
In claim 12, at column 9, line 44 insert --signal-- before “representing”.

In claim 16, at column 9, line 63 delete “;”.
In claim 16, at column 10, line 1 insert --said-- before “closed”.

In claim 19, at column 10, line 19 change the first occurrence of “a” to --said--.
In claim 19, at column 10, line 21 change “a” to --said--.

In claim 20, at column 10, line 39 insert --a-- before “power”.
In claim 20, at column 10, line 41 insert --error-- before “signal” and insert --feedback-- before “controller”.
In claim 20, at column 10, line 42 insert --, and-- after “element”.

In claim 25, at column 11, line 9 delete “an error signal generator to connect to a microcontroller”.
In claim 25, at column 11, line 10 delete “and to” and change “gererate” to --generating--.

UNITED STATES PATENT AND TRADEMARK OFFICE

CERTIFICATE OF CORRECTION

PATENT NO. : 7,311,081 B2
APPLICATION NO. : 11/178095
DATED : December 25, 2007
INVENTOR(S) : Williams et al.

It is certified that error appears in the above-identified patent and that said Letters Patent is hereby corrected as shown below:

In claim 25, at column 11, line 11 insert --at an error signal gererator-- after "setpoint signal".
In claim 25, at column 11, line 12 change "an" to --said-- and delete ";".
In claim 25, at column 11, line 13 change "cloased" to --closed--.

In claim 28, at column 12, line 7 insert --at an error signal generator-- after "feedback signal".

Signed and Sealed this

Twenty-third Day of December, 2008

JON W. DUDAS
*Director of the United States Patent and Trademark Office*